US006425778B1

(12) United States Patent
Haq et al.

(10) Patent No.: US 6,425,778 B1
(45) Date of Patent: Jul. 30, 2002

(54) PCI CARD RETENTION GUIDE

(75) Inventors: Mohammed N. Haq, Lacey; Casey R. Winkel, Olympia, both of WA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/875,086

(22) Filed: Jun. 7, 2001

(51) Int. Cl.[7] ..... H01R 13/64
(52) U.S. Cl. ..... 439/377; 439/153; 439/160
(58) Field of Search ..... 439/377, 327, 439/152, 376, 64, 153, 160; 361/801, 756, 683, 753, 796, 802, 803, 684

(56) References Cited

U.S. PATENT DOCUMENTS 4,898,540 A * 2/1990 Saito ..... 439/153
6,162,073 A 12/2000 Haq et al.
6,181,565 B1 * 1/2001 Schmitt et al. ..... 361/756

* cited by examiner

*Primary Examiner*—Tho D. Ta
*Assistant Examiner*—Phuongchi Nguyen
(74) *Attorney, Agent, or Firm*—Antonelli, Terry, Stout & Kraus, LLP

(57) ABSTRACT

A device to hold a peripheral component interconnect (PCI) card. The device may include a first member having a first side wall extending in a longitudinal direction, a second member having a tab mechanism and a living hinge coupled between the first member and the second member. The living hinge may allow the second member to move between a first (open) position and a second (closed) position. The living hinge may also allow the tab mechanism to abut against the PCI card when the second member is in the closed position.

32 Claims, 5 Drawing Sheets

PCI CARD RETENTION GUIDE

FEILD

The present invention is directed to peripheral component interconnect (PCI) structures.

BACKGROUND

Modern computer systems, such as servers, workstations and personal computers, include cards that comply with the PCI bus specification, the latest version of which is "PCI Local Bus Specification, Revision 2.2" set forth by the PCI Special Interest Group (SIG) on Dec. 18, 1998. Hereinafter, such cards in compliance with the PCI bus specification (that can be electrically connected to PCI busses complying with the PCI bus specification) are called PCI cards. Currently, mechanisms engage/disengage PCI cards with/from slots in the system (e.g., computer). For example, a top access structure may require entry and removal of the PCI card vertically through the top of the computer chassis or frame. It is desirable to minimize horizontal and vertical movement of the PCI card while coupled to a slot.

BRIEF DESCRIPTION OF THE DRAWINGS

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and that the invention is not limited thereto.

The following represents brief descriptions of the drawings in which like reference numerals represent like elements and wherein.

DETAILED DESCRIPTION

Figure 1A:
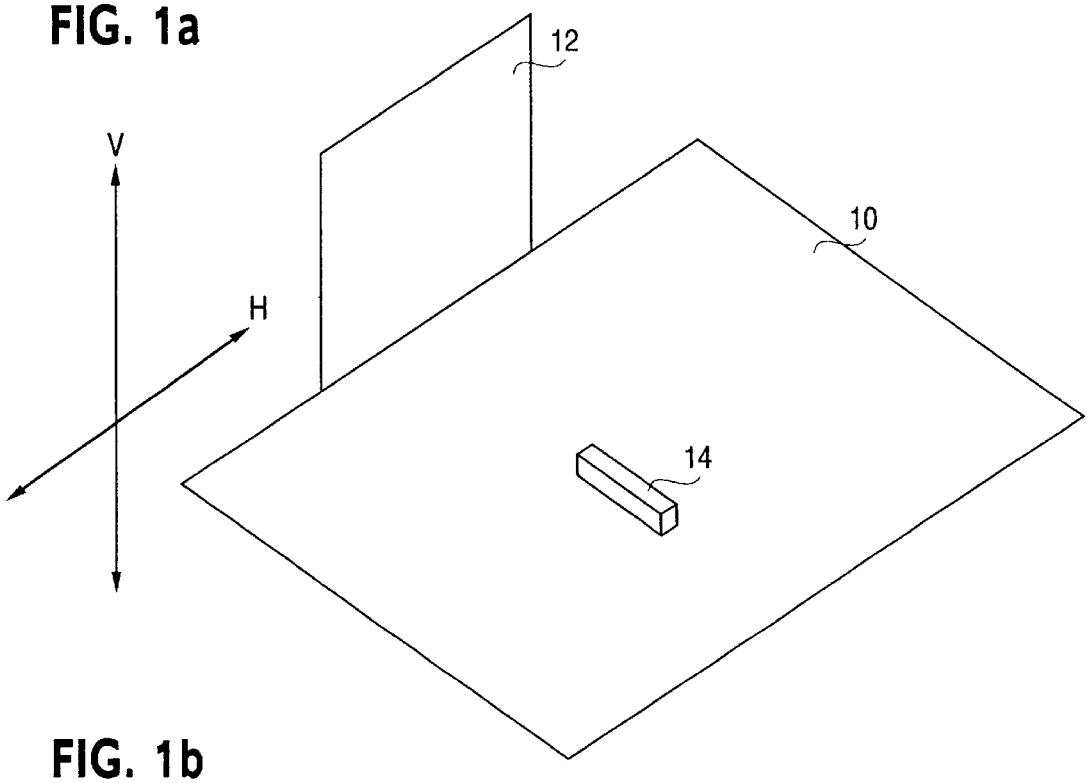
FIG. 1*a* is an example structure of a computer chassis and FIG. 1*b* is an example structure of a PCI card mounted to the structure of FIG. 1*a;*

In the following detailed description, like reference numerals and characters may be used to designate identical, corresponding or similar components in differing figure drawings. Further, any reference in the specification to "one embodiment", "an embodiment", "example embodiment", etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

FIG. 1*a* is an example of a base board mounted within a computer chassis (or frame). For example, FIG. 1*a* shows a base board 10 and a slot 14 on the base board 10 for receiving a peripheral component interconnect (PCI) card. FIG. 1*a* further shows a back wall 12 such as sheet metal provided within the computer chassis for connecting to and/or supporting the base board 10.

Figure 1B:
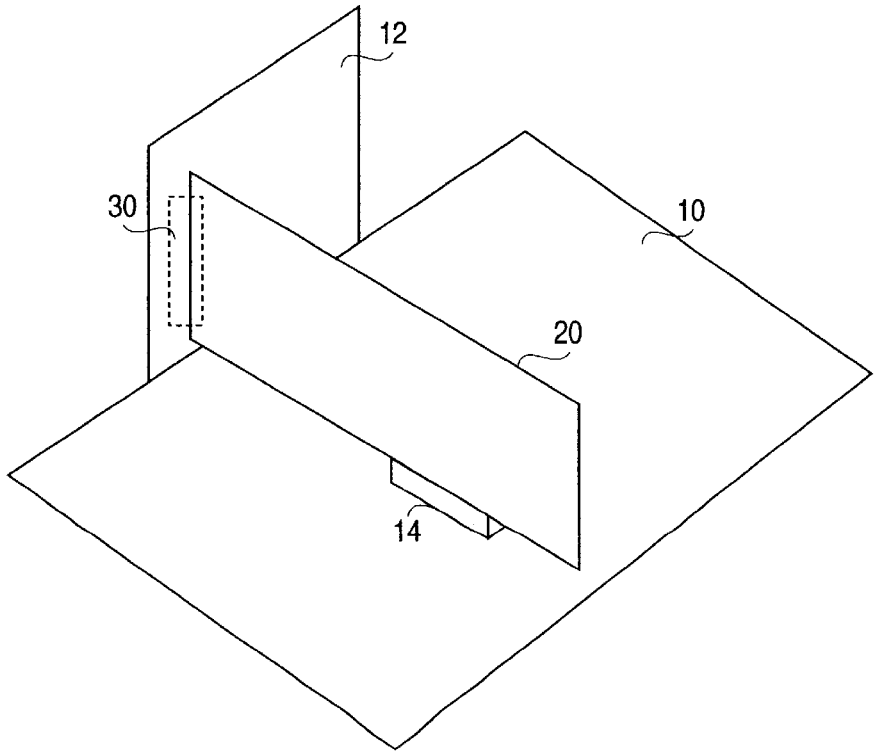

FIG. 1*b* shows a PCI card 20 mounted to the slot 14 on the base board 10. In these figures and the example figures to follow, the base board 10 will be described as being horizontal and the back wall 12 will be described as being vertical. To illustrate this and to aid in the following descriptions, FIG. 1*a* shows a vertical arrow V extending in a vertical direction and a horizontal arrow H extending in a horizontal direction. These arrangements are equally applicable to different orientations other than that just described.

In FIG. 1*b,* the PCI card 20 is vertically provided within the computer chassis and couples to the slot 14 on the horizontal base board 10. Thus, the PCI card 20 may be approximately perpendicular to the surface of the base board 10. The PCI card 20 may also be approximately perpendicular to the surface of the back wall 12. A supporting device 30 may be provided on the back wall 12 to prevent movement of the card 20. Accordingly, the PCI card 20 may be supported within the computer chassis using the slot 14 and the supporting device 30.

Figure 2:
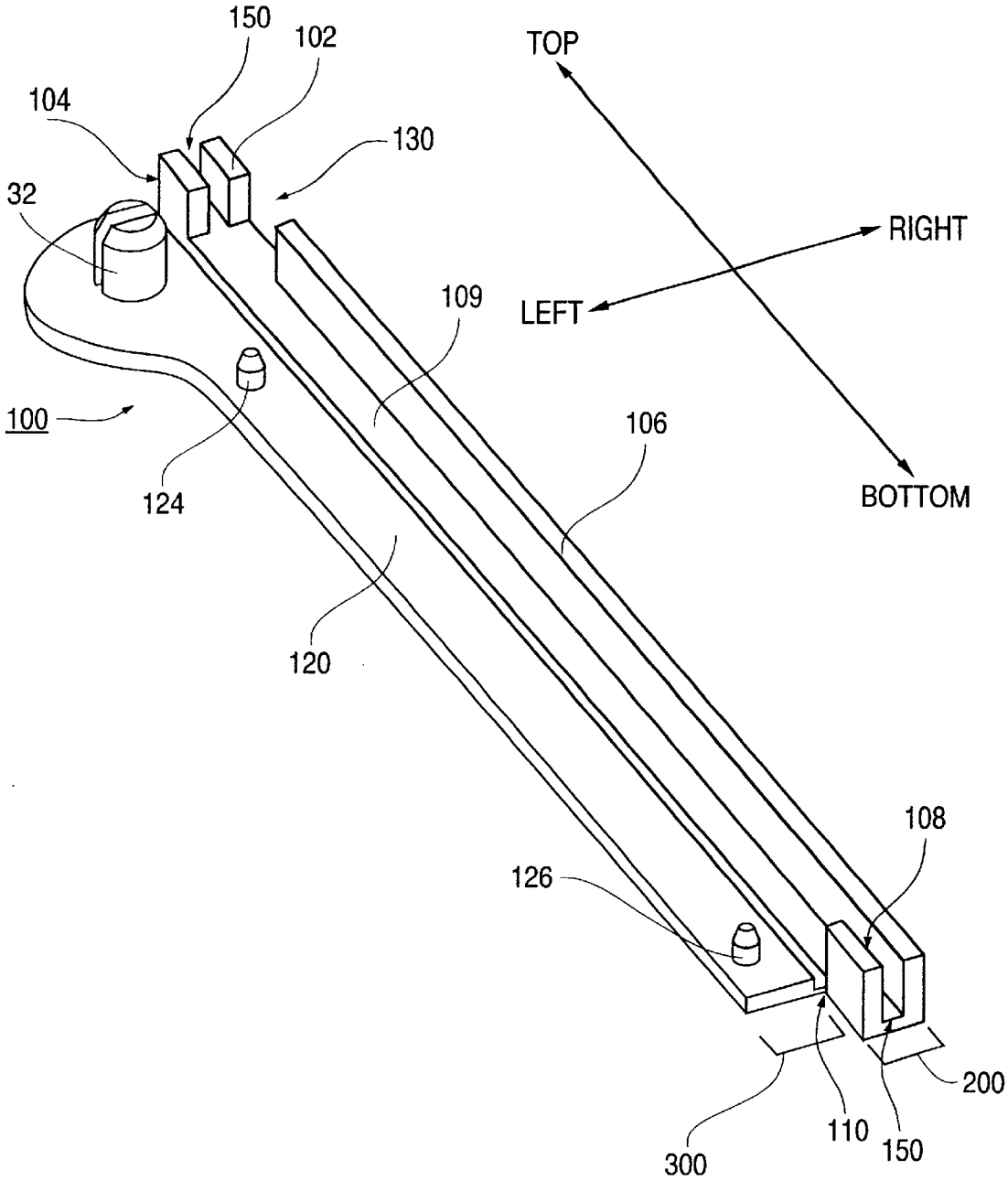
FIG. 2 illustrates a PCI guard retention guide according to an example embodiment of the present invention.

FIG. 2 shows a PCI guard retention guide 100 according to an example embodiment of the present invention. Other embodiments and configurations are also within the scope of the present invention. The PCI guard retention guide 100 may be provided as the supporting device 30 so as to support and restrain movement of the PCI card 20 when the card 20 is coupled to the slot 14. That is, the PCI guard retention guide 100 may be mounted to the back wall 12 and may prevent horizontal movement of the PCI card 20 as will be described.

More specifically, FIG. 2 shows that the PCI guard retention guide 100 includes a first member 200, a second member 300 and a living hinge 110 that couples the first member 200 to the second member 300 as will now be described.

To help in the following discussion, FIG. 2 shows several directions (top, bottom, right and left) that will be used to help describe features of the PCI guard retention guide 100. The first member 200 may include a first side wall (top) 102 and a second side wall (top) 104 provided at a top end of the PCI guard retention guide 100. A main side wall 106 may be provided along a right-hand side of the first member 200 and extend toward the bottom of the PCI guard retention guide 100. A first side wall (bottom) 108 may be provided on the bottom left of the PCI card retention guide 100. A groove 150 may be provided extending in a vertical direction from the top to the bottom of the first member 200. More specifically, the groove 150 extends from between the first side wall 102 and the second side wall 104 at the top and extends toward the bottom (adjacent to the main side wall 106) between the main side wall 106 and the first side wall (bottom) 108. The groove 150 may be formed by a top planar surface 109 of the first member 200 or the groove 150 may extend below the top planar surface 109 (i.e., the groove 150 extends below the surface 109). A snap opening 130 may be provided between the first side wall (top) 102 and the main side wall 106. The snap opening 130 may operate to hold the second member 300 in a closed position as will be described below. The main side wall 106 may be separate from the first side wail 102 (and the snap opening 130 is provided between the two) or the first side wall 102 may be part of the main side wall 106.

The second member 300 may include a relatively planar top surface 120 on which a top tab 124 and a bottom tab 126 extend from the top surface 120. The top tab 124 and the bottom tab 126 operate to abut (and thereby support) a side (i.e., left-hand side) of the PCI card 20 when the second member 300 is moved from an open position (shown in FIG. 2) to a closed position (shown in FIG. 5*b*). The second member 300 further includes a snap protrusion 132 extending from the top surface 120 that will be received within the snap opening 130 when the second member 300 is moved to the closed position.

The living hinge (or hinge device) 110 couples the first member 200 and the second member 300 to form one integral component. As shown in FIG. 2, the living hinge 110 may be a region that is not as thick as the first member 200 or the second member 300. That is, the surface of the living hinge 110 may not be parallel with the surface 109 (of the first member 200) or with the surface 120 (of the second member 300). The living hinge 110 allows the second member 300 to move between an open position and a closed position while the first member 200 remains stationary. That is, the living hinge 110 may essentially operate similar to the hinge of a door so as to allow different orientations of the second member 300 relative to the first member 200.

FIG. 2 shows the first member 200 and the second member 300 having planar top surfaces and the second member 300 provided in an open position such that the surface 120 is relatively planar with the surface 109 of the first member 200. When a PCI card 20 is provided within the groove 150, the second member 300 may move in a hinge like manner such that the top tab 124 and the bottom tab 126 abut against a side of the PCI card 20. The main side wall 106 may abut the other side of the PCI card 20. That is, the PCI card 20 may be supported (or held in place) on opposite sides by the main side wall 106 and the top/bottom tabs 124/126. This arrangement may prevent horizontal (i.e., left-right in FIG. 2) movement of the PCI card 20 while the card 20 is mounted within the chassis of the computer and coupled to the slot 14. Accordingly, the living hinge 110 allows the second member 300 to move between the open position (shown in FIG. 2) and a closed position in which the surface 120 of the second member 300 is relatively perpendicular to the surface 109 of the first member 200. In order to maintain the closed position, the snap protrusion 132 may fit within the snap opening 130. A mechanism may be provided to further hold the snap protrusion 132 within the snap opening 130. That is, when the second member 300 moves from the open position (shown in FIG. 2) to a closed position in which the members 200 and 300 are relatively perpendicular to one another, the snap protrusion 132 may fit snugly within the snap opening 130 such that the snap protrusion 132 is not easily removed from the snap opening 130. This thereby maintains the top tab 124 and the bottom tab 126 against the side (i.e., left-hand side) of the PCI card 20. The PCI card 20 preferably stays within the groove 150 in an area between the snap opening 130 and the bottom of the card retention guide 100. Vertical movement of the PCI card 20 may be restricted by the slot 14 (or the slot connector) that couples with the PCI card 20 and by the snap protrusion 132 that crosses over the groove 150 (when in the closed position) to prevent vertical movement of the card 20. As discussed above, horizontal movement of the card 20 may be prevented (or reduced) based on the top tab 124 and the bottom tab 126 and the main side wall 106.

The PCI guard retention guide shown in FIG. 2 may be formed by a plastic (or other synthetic material) molding technique in which the first member 200, second member 300 and the living hinge 110 are integrally formed. The main side wall 106, the snap protrusion 132, the first side wall (top) 102, the second side wall (top) 104 and/or the first side wall (bottom) 108 may also be integrally formed by the plastic molding. The top tab 124 and the bottom tab 126 may also be integrally formed by the plastic molding technique or may be separately produced such as by using rubber stoppers to abut against the side of the PCI card 20. Other techniques for forming a PCI card retention guide 100 are also within the scope of the present invention.

Figure 3:
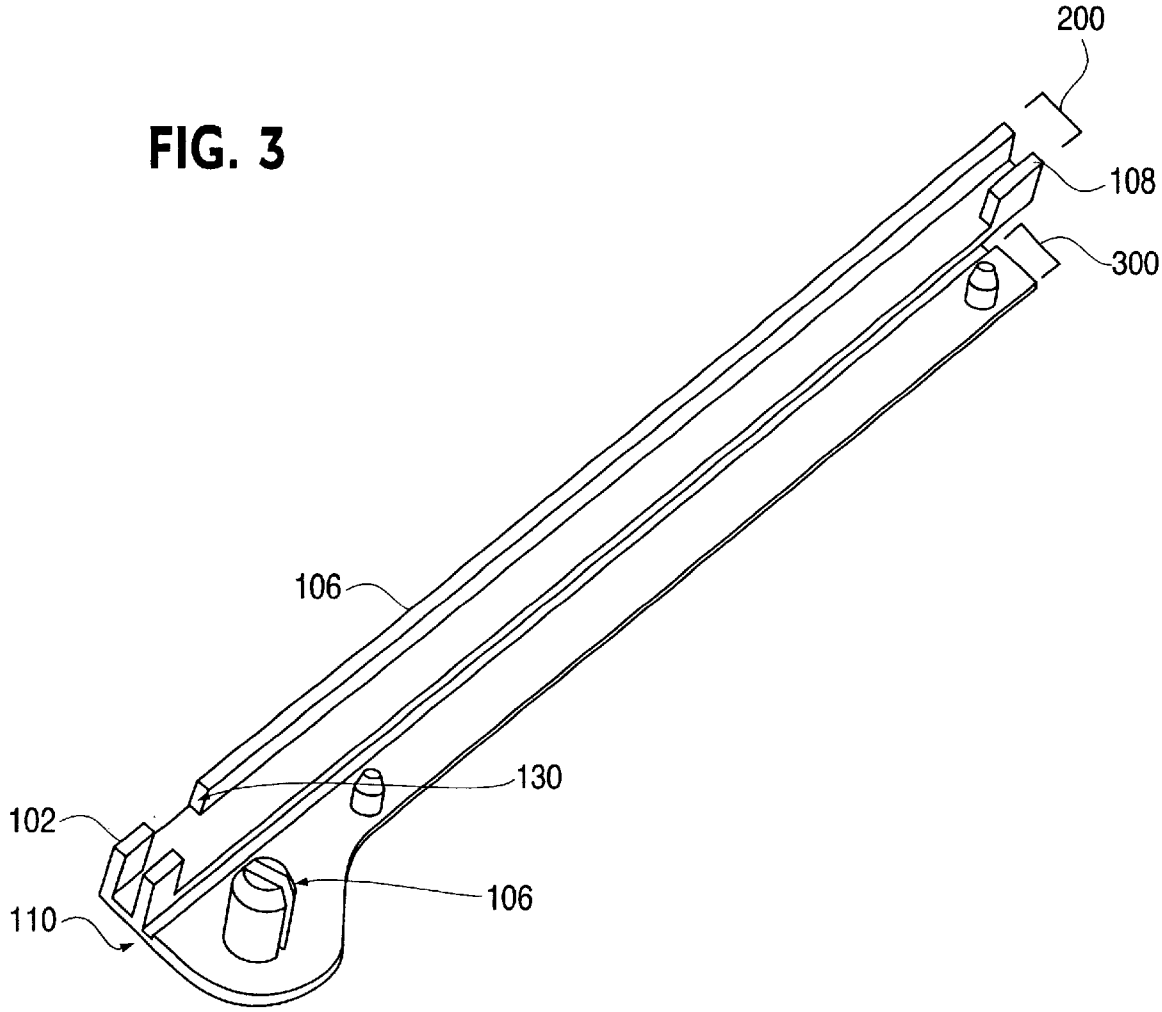
FIG. 3 illustrates another view of the PCI guard retention guide shown in FIG. 2.

FIG. 3 illustrates another view of the PCI guard retention guide 100 according to an example embodiment of the present invention. FIG. 3 shows the snap opening 130 and the snap protrusion 132 that will be fitted within the snap opening 130 to form a snap mechanism.

Figure 4:
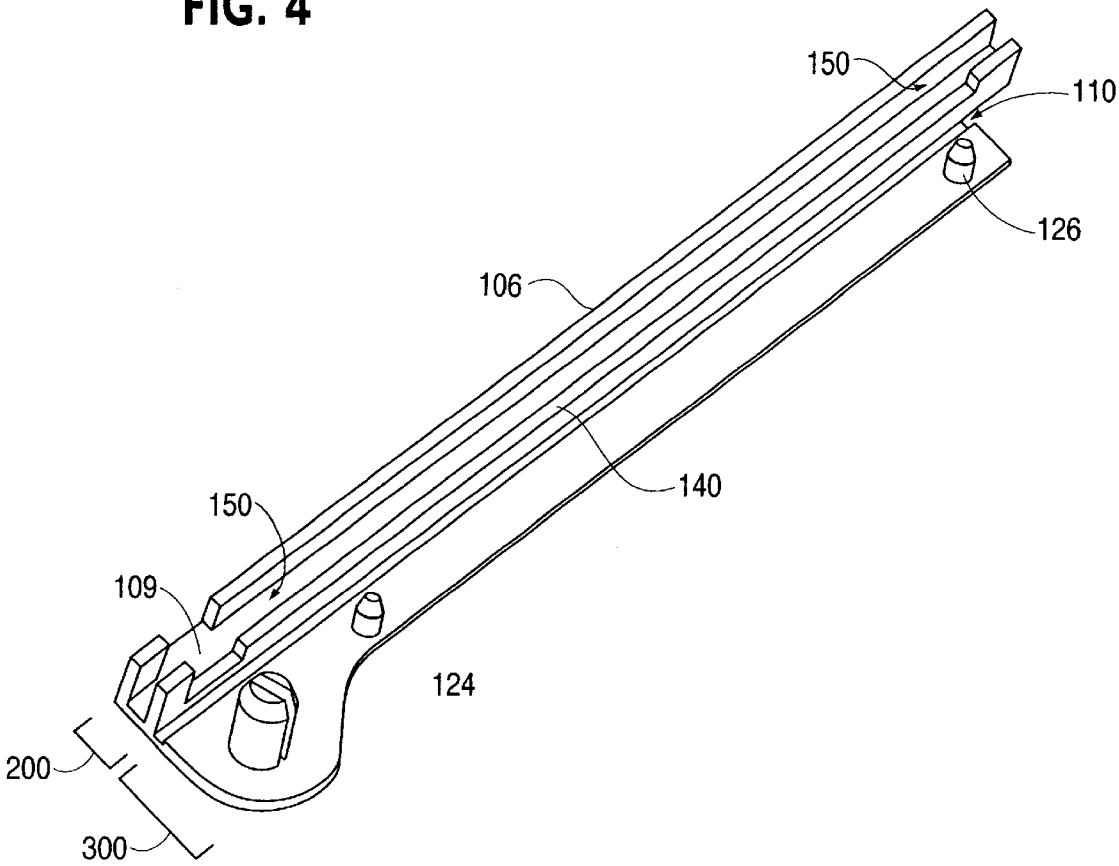
FIG. 4 illustrates a PCI guard retention guide having a raised side wall according to an example embodiment of the present invention.

FIG. 4 illustrates another embodiment of the present invention. This embodiment further includes a side wall 140 on the first member 200. The side wall 140 parallels the main side wall 106, the living hinge 110 and the groove 150. That is, the side wall 140 may further prevent horizontal movement of the card 20 when it is provided within the groove 150. The side wall 140 may not extend above the surface 109 as high as the main side wall 106. However, the side wall 140 provides an additional mechanism (beyond the top tab 124 and the bottom tab 126) to hold or support the PCI card 20 within the groove 150.

Figure 5B:
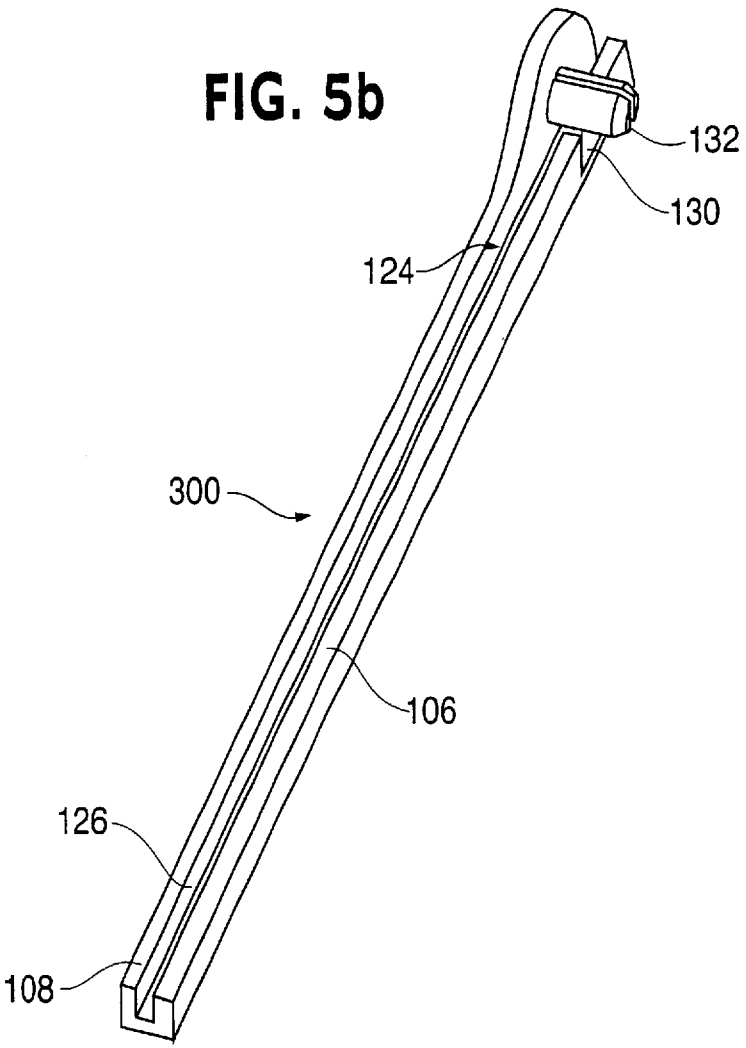
FIG. 5*a* illustrates a PCI guard retention guide in an open position and FIG. 5*b* illustrates the PCI guard retention guide in a closed position.
Figure 5A:
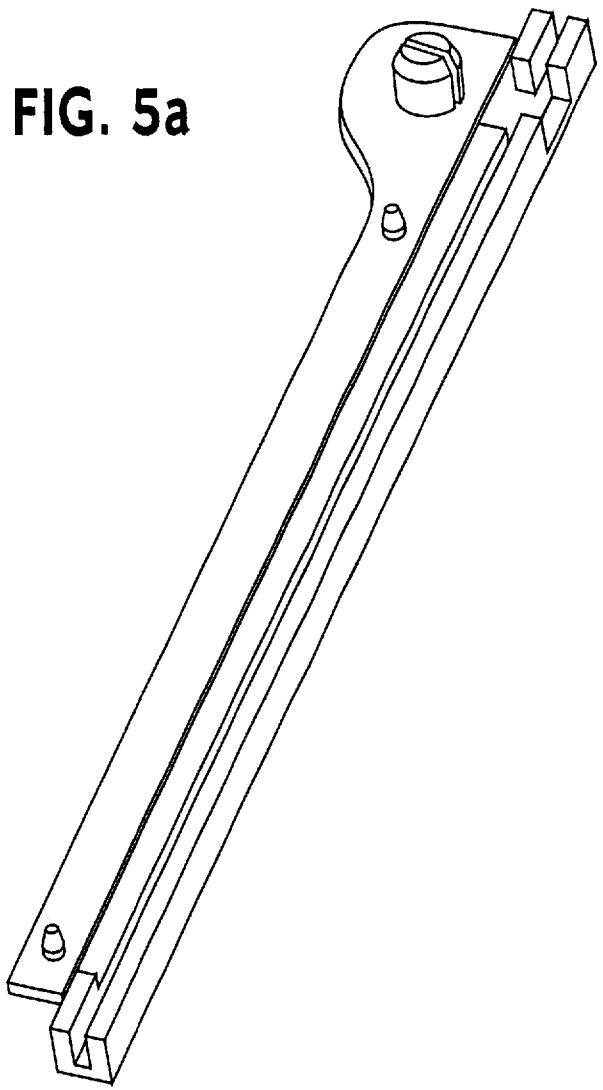

FIG. 5*a* shows the PCI card retention guide 100 in an open position (similar to FIG. 2). FIG. 5*b* shows the same PCI card retention guide 100 in a closed position. As can be seen, in the closed position the snap protrosion 132 fits within the snap opening 130 so as to maintain the closed position. Although not shown, the tabs 124 and 126 abut one side of a card (not shown) and the main side wall 106 abuts the other side of the card.

The above embodiments have been described with respect to a PCI card. Embodiments of the present invention are also applicable to other type of cards.

While the present invention has been described with reference to a number of illustrative embodiments thereof, it is understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A device to hold a peripheral component interconnect (PCI) card comprising:

a first member including a first side wall extending in a longitudinal direction along a first side of said first member;

a second member having a tab mechanism; and a living hinge coupled between said first member and said second member and extending in said longitudinal direction along a longitudinal axis and along a second side of said first member, said living hinge to allow said second member to rotate about said longitudinal axis from a first position to a second position relative to said first member, said living hinge further allowing said tab mechanism to abut against said PCI card when said second member is in said second position.

2. The device of claim 1, wherein said first member further includes a groove extending in said longitudinal direction between said first side of said first member and said second side of said first member, said groove to receive said PCI card.

3. The device of claim 1, wherein said tab mechanism comprises a first protrusion and a second protrusion, said first protrusion and said second protrusion to abut said PCI card when said second member is in said second position and said PCI card is received within said groove.

4. The device of claim 1, wherein said first member and said second member are provided approximately planar to one another when said second member is in said first position, and said first member and said second member are provided approximately perpendicular to one another when said second member is in said second position.

5. The device of claim 1, wherein said first member further comprises a second side wall extending in said longitudinal direction along said second side of said first member and provided adjacent said living hinge such that said PCI card is provided between said first side wall and said second side wall when said PCI card is received in said groove.

6. The device of claim 1, wherein said device is formed of plastic and said first member, said living hinge and said second member are integrally formed.

7. The device of claim 1, wherein in said second position, said second member is approximately perpendicular to said first member.

8. The device of claim 1, further comprising a snap mechanism to hold said second member in said second position.

9. The device of claim 8, wherein said snap mechanism comprises a snap protrusion provided on said second member and a snap opening formed along said first side of said first member, said snap opening to receive said snap protrusion when said second member is moved to said second position.

10. A retention member comprising:

a first member extending in a longitudinal direction from a first end to a second end, said first member including a first side wall extending in said longitudinal direction and a groove adjacent to said first side wall and extending in said longitudinal direction, said groove to receive a peripheral component interconnect (PCI) card;

a second member having a tab mechanism to abut a side of said PCI card when said PCI card is received in said groove; and a living hinge coupled between said first member and said second member and extending in said longitudinal direction along a longitudinal axis, said living hinge to allow said second member to rotate about said longitudinal axis from a first position to a second position relative to said first member, said living hinge further allowing said tab mechanism to abut against said PCI card when said second member is in said second position.

11. The retention member of claim 10, wherein said tab mechanism comprises a first protrusion and a second protrusion, said first protrusion and said second protrusion to abut said PCI card when said second member is in said second position and said PCI card is received within said groove.

12. The retention member of claim 10, wherein said first member and said second member are provided approximately planar to one another when said second member is in said first position, and said first member and said second member are provided approximately perpendicular to one another when said second member is in said second position.

13. The retention member of claim 10, wherein said first member further comprises a second side wall extending in said longitudinal direction and provided adjacent said living hinge such that said PCI card is provided between said first side wall and said second side wall when sad PCI card is received in said groove.

14. The retention member of claim 10, wherein said retention member is formed of plastic and said first member, said living hinge and said second member are integrally formed.

15. The device of claim 10, wherein in said second position, said second member is approximately perpendicular to said first member.

16. The retention member of claim 10, further comprising a snap mechanism to hold said second member in said second position.

17. The retention member of claim 16, wherein said snap mechanism comprises a snap protrusion provided on said second member and a snap opening formed along said side wall of said first member, said snap opening to receive said snap protrusion when said second member is moved to said second position.

18. The retention member of claim 10, wherein said first end corresponds to a top end and said second end corresponds to a bottom end when said PCI card is received in said groove.

19. The retention member of claim 18, further comprising a first side wall structure provided at said first end adjacent said living hinge and a second side wall structure provided at said second end adjacent said hinge.

20. A device comprising:

a first member including a first side wall extending in a longitudinal direction along a first side of said first member, said first side wall to abut a first side of a card;

a second member having a tab mechanism; and a hinge device coupled between said first member and said second member and extending in said longitudinal direction along a longitudinal axis and along a second side of said first member, said hinge device to allow said second member to rotate about said longitudinal axis from a first position to a second position relative to said first member, said tab mechanism to abut against a second side of said card when said second member is in said second position.

21. The device of claim 20, wherein said card comprises a peripheral component interconnect card.

22. The device of claim 20, wherein said tab mechanism comprises a first protrusion and a second protrusion, said first protrusion and said second protrusion to abut said card when said second member is in said second position and said card is received within a groove of said device.

23. The device of claim 20, wherein said first member and said second member are provided approximately planar to one another when said second member is in said first position, and said first member and said second member are provided approximately perpendicular to one another when said second member is in said second position.

24. The device of claim 20, wherein said first member further comprises a second side wall extending in said longitudinal direction and provided adjacent said hinge device such that said card is provided between said first side wall and said second side wall when said card is received in a groove of said device.

25. The device of claim 20, wherein said device is formed of plastic and said first member, said hinge device and said second member are integrally formed.

26. The device of claim 20, wherein in said second position, said second member is approximately perpendicular to said first member.

27. The device of claim 20, wherein said first member further includes a groove extending in said longitudinal direction between said first side of said first member and said second side of said first member, said groove to receive said card.

28. The device of claim 20, further comprising a snap mechanism to hold said second member in sad second position.

29. The device of claim 28, wherein said snap mechanism comprises a snap protrusion provided on said second member and a snap opening formed along said first side wall of said first member, said snap opening to receive said snap protrusion when said second member is moved to said second position.

30. A device to hold a peripheral component interconnect (PCI) card comprising:

a first member including a first side wall extending in a longitudinal direction along a first side of said first member;

a second member having a tab mechanism; and a living hinge coupled between said first member and said second member and extending in said longitudinal direction along a second side of said first member, said living hinge to allow said second member to move between a first position and a second position, said living hinge further allowing said tab mechanism to abut against said PCI card when said second member is in said second position, wherein said tab mechanism comprises a first protrusion and a second protrusion, said first protrusion and said second protrusion to abut said PCI card when said second member is in said second position and said PCI card is received within said groove.

31. A device to hold a peripheral component interconnect (PCI) card comprising:

a first member including a first side wall extending in a longitudinal direction along a first side of said first member;

a second member having a tab mechanism; and a living hinge coupled between said first member and said second member and extending in said longitudinal direction along a second side of said first member, said living hinge to allow said second member to move between a first position and a second position, said living hinge further allowing said tab mechanism to abut against said PCI card when said second member is in said second position, wherein said first member and said second member are provided approximately planar to one another when said second member is in said first position, and said first member and said second member are provided approximately perpendicular to one another when said second member is in said second position.

32. A device comprising:

a first member including a first side wall extending in a longitudinal direction along a first side of said first member, said first side wall to abut a first side of a card;

a second member having a tab mechanism; and a hinge device coupled between said first member and said second member and extending in said longitudinal direction along a second side of said first member, said hinge device to allow said second member to move between a first position and a second position, said tab mechanism to abut against a second side of said card when said second member is in said second position, wherein said first member and said second member are provided approximately planar to one another when said second member is in said first position, and said first member and said second member are provided approximately perpendicular to one another when said second member is in said second position.

* * * * *